US005469938A

United States Patent [19]

Biewald et al.

[11] Patent Number: 5,469,938

[45] Date of Patent: Nov. 28, 1995

[54] GUIDE ARRANGEMENT FOR ELEVATORS

[75] Inventors: Joachim Biewald, Winnenden/Degenhof; Volker Scheub, Waiblingen; Helge Holler, Pforzheim; Karl Fenkl, Stuttgart; Stefan Hugel, Schwaikheim; Martin Grosser, Böblingen; Peter Schneider, Ditzingen; Wolfgang Barth, Bietigheim-Bissingen; Hermann Moll, Weissach im Tal; Horst Pollmann, Weil der Stadt, all of Germany

[73] Assignee: C. Haushahn GmbH & Co., Stuttgart, Germany

[21] Appl. No.: 190,879

[22] Filed: Feb. 2, 1994

[30] Foreign Application Priority Data

Feb. 15, 1993 [DE] Germany ..... 93021194U

[51] Int. Cl.[6] ..... B66B 7/02

[52] U.S. Cl. ..... 187/408; 52/506.03

[58] Field of Search ..... 187/406, 408; 52/698, 508, 506, 506.03, 506.04, 167 CB

[56] References Cited

U.S. PATENT DOCUMENTS

| | | | |
|---|---|---|---|
| 3,211,259 | 10/1965 | Tofanelli | 187/408 |
| 3,289,372 | 12/1966 | Adams et al. | 52/506.03 |
| 3,845,842 | 11/1974 | Johnson | 187/408 |
| 4,317,418 | 3/1982 | Courshon, Jr. et al. | 52/506.03 |

*Primary Examiner*—Kenneth Noland
*Attorney, Agent, or Firm*—Friedrich Kueffner

[57] ABSTRACT

A guide arrangement for elevators, particularly for vertical elevators. The guide arrangement is arranged in a shaft having a shaft wall. The guide arrangement includes a self-contained inherently stiff rail frame with at least two parallel guide rails which are rigidly connected to each other, the guide arrangement further includes fastening members for connecting the rail frame to the shaft wall, wherein the fastening members are springs.

19 Claims, 10 Drawing Sheets

GUIDE ARRANGEMENT FOR ELEVATORS

BACKGROUND OF THE INVENTION

1. Field of the Invention

The present invention relates to a guide arrangement for elevators, particularly for vertical elevators. The arrangement includes guide rails which are fastened to a shaft wall by means of fastening members.

2. Description of the Related Art

In general, in known guide rail systems for elevators guided in vertical shafts, there is the problem that any uneven areas of the shaft wall must be taken into consideration particularly carefully when the rails are assembled and must be compensated for by an adjusting mechanism. In the case of very high shafts, i.e., very long guide rails, settling of the shaft or a different thermal expansion behavior of the guide rails relative to the shaft wall may lead to deformation of the rails and deviations from the straightness of the rails when an unyielding connection is provided between the guide rail and the shaft wall.

Finally, in so-called piggyback elevators, there is the general problem that, because of the eccentric suspension of the elevator car and the laterally extending guide rails, high horizontal forces must be introduced through the rail stirrups into the shaft wall and must be absorbed by the shaft wall. This requires a sufficient stability of the shaft wall. In addition, the strength requirements of the connecting means are very high. Also, the number of necessary rail stirrups increases with the weight of the elevator car and the payload because of the necessary narrow spacings between rail stirrups. These limitations make it questionable whether piggyback-type elevators with heavy elevator car and/or high payloads can be realized within a technically economical framework.

SUMMARY OF THE INVENTION

Therefore, it is the primary object of the present invention to provide a guide arrangement for elevators of the above-described type which is not sensitive to unevenness of the shaft wall, is independent of the condition of the shaft wall and which is not subjected to distortions in the case of different thermal expansion of the guide rails relative to the wall or when the building containing the elevator shaft settles. In particular, the arrangement is also to be suitable for a piggyback-type elevator.

In accordance with the present invention, the guide arrangement of the above-described type is constructed as a self-contained or self-supporting, inherently stiff rail frame. The rail frame has at least two parallel guide rails which are rigidly connected to each other. The fastening members include springs, wherein the rail frame is connected to the shaft wall through the springs.

The advantage of the guide arrangement proposed in accordance with the present invention is to be seen in the fact that, due to the very bending-stiff, self-contained rail frame, the omission of the otherwise rigid rail stirrups, and the use of the springs, a system has become possible which corresponds to that of an elastically supported girder. Because of its inherent stiffness, this girder system discharges any loads acting on it at several connecting points.

When the combination of rails and spring stiffness is correctly selected, the number of springs can be reduced while the force introduced into the shaft wall is simultaneously reduced. Since the forces to be transmitted have been reduced, the rail stirrup may have lighter dimensions and, thus, may be less expensive to manufacture, and are easier to manipulate because of their lighter weight. In addition, since the number of stirrups has been reduced, the assembly can be carried out faster and with fewer alignment operations.

Of course, the guide arrangement proposed in accordance with the present invention can also be utilized in elevator cars which are guided and suspended in the conventional manner and which have high weights and possibly an eccentric payload, which may be the case in heavy cargo elevators.

In accordance with a preferred feature of the present invention, each fastening member has a fastening element at the side of the wall and a fastening element on the side of the rail. Moreover, two spring stirrups are provided for each fastening member symmetrically relative to the longitudinal axis of the rail on both sides of each guide rail, wherein always one fastening element on the wall is connected to the corresponding fastening element on the rail through two spring stirrups.

In accordance with another preferred feature, each spring stirrup is constructed as a spring rod which is bent at approximately a right angle at the end on the side of the rail, wherein the spring stirrup is pivotally hinged at this end to the fastening element on the side of the rail, and wherein the other end on the side of the wall is connected to the respective fastening element on the side of the wall.

In accordance with another preferred feature, each fastening element on the side of the rail includes a pivoting bearing whose articulated member is connected to a rail clamp which, in turn, is clamped to the guide rail. The pivoting bearing facilitates a slight pivoting of the guide rail about the longitudinal axis thereof. Accordingly, this cardanic suspension of the guide rails makes it possible to mount the rigid rail frame even on shaft walls of shafts whose cross-sectional shape slightly deviates from the rectangular shape or square shape.

In accordance with a further preferred feature, each spring rod has on its end on the side of the wall another bent portion which is located in a plane which extends perpendicularly to the plane of the bent portion on the side of the rail. Each fastening element on the side of the wall has an adjusting element for adjusting and thereby fixing the angle of each spring rod relative to the longitudinal axis of the rail and, thus, the distance of each guide rail from the wall.

The bending stiffness of each guide rail is obtained by constructing the guide rail with integrated elevator car running surface and counterweight running surface, an additional catch rail and flanges for mounting rail joint connectors. Preferably, the guide rail is constructed as a hollow aluminum section.

The guide rails which extend parallel to each other are fixedly connected to each other at the lower ends thereof by means of a base carrier and at the upper ends thereof by means of an upper suspension carrier. In addition, the guide rails are connected by means of cross beams which are arranged at defined distances from each other.

In accordance with another preferred feature, at least one guide roller or drive roller is integrated in the base carrier and the upper suspension carrier has at least one guide roller or drive roller.

The base carrier preferably rests on the bottom of the shaft.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there is illustrated and described a preferred embodiment of the invention.

DETAILED DESCRIPTION OF THE PREFERRED EMBODIMENTS

Figure 1:
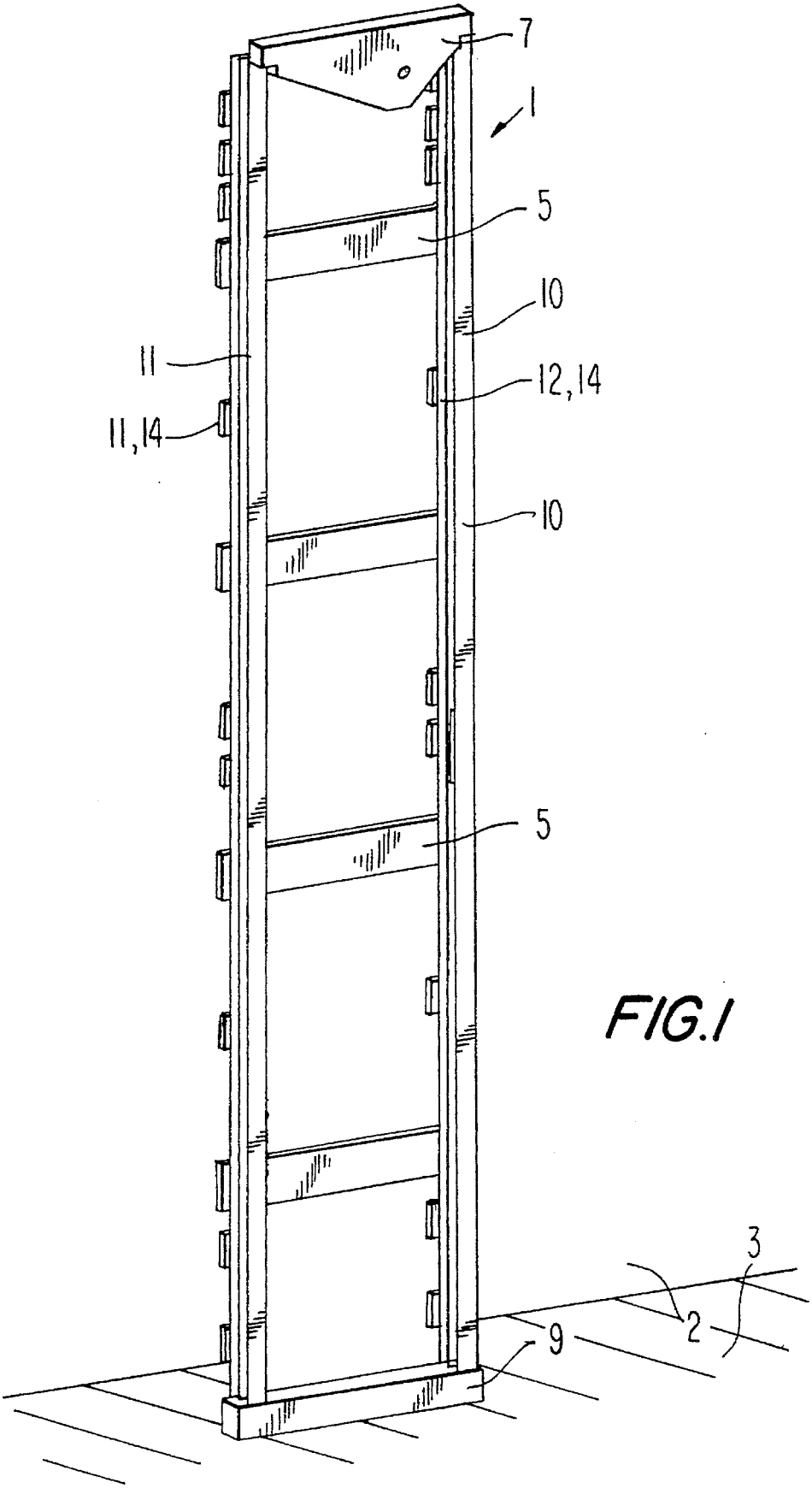
FIG. 1 is a schematic perspective view of a preferred embodiment of a rail frame of the arrangement according to the present invention.

FIG. 1 of the drawing shows the overall rail frame 1 according to the present invention which is bending-stiff and self-contained. The rail frame 1 has two parallel guide rails 10 and 11 which are connected to each other by means of several cross beams 5 and a base carrier 9 as well as an upper suspension carrier 7. The rail frame is placed with the base carrier 9 on the shaft bottom 3 and is fastened to a wall 2 in a resilient manner by means of wall connecting members 12–14. The guide rails 10 and 11 proper are constructed in the form of triple T hollow aluminum sections which are stiff with respect to bending and torsion, as will be explained in more detail below. Accordingly, the entire rail frame 1 is very stiff with respect to bending.

Figure 2:
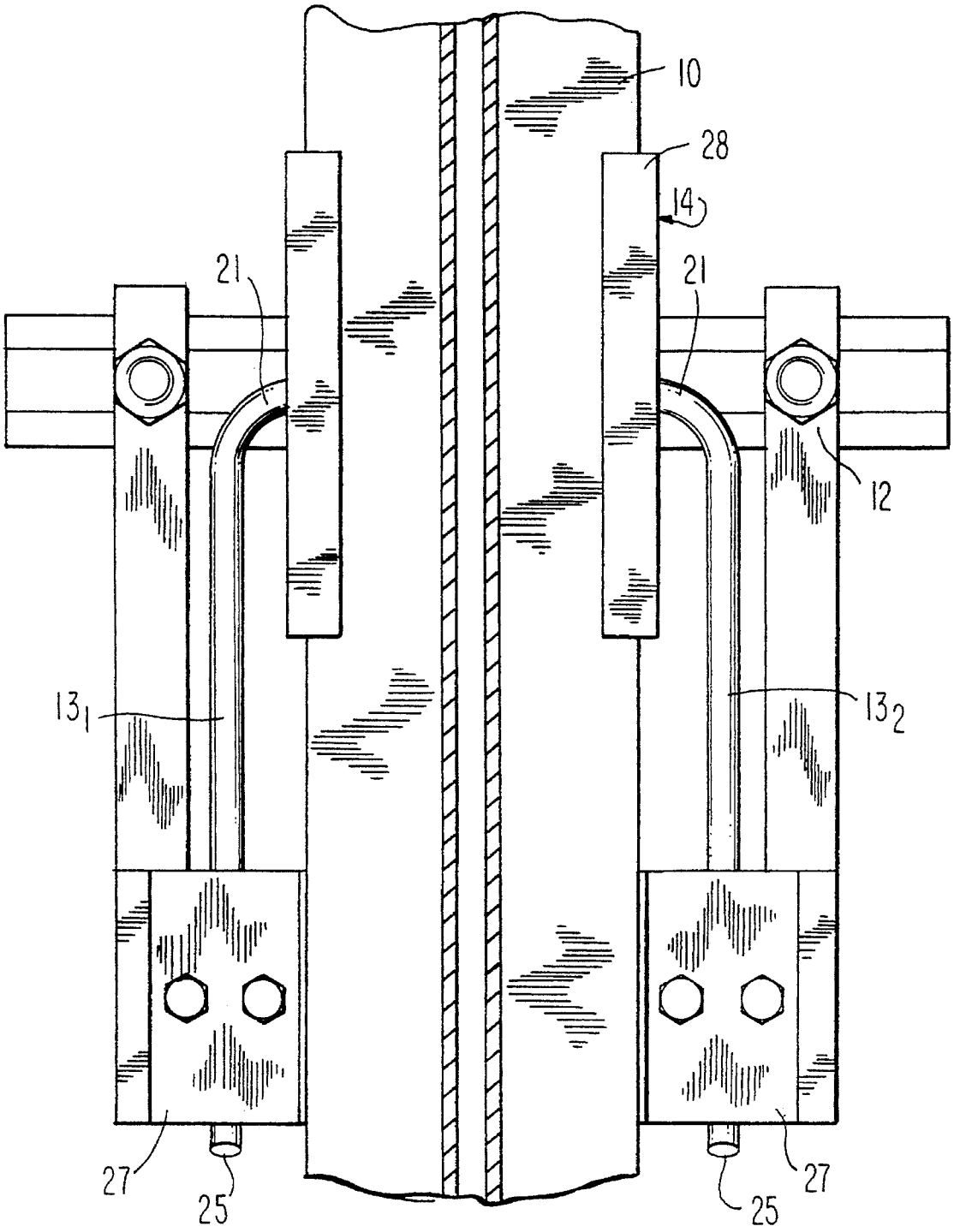
FIG. 2 is a side view, on a larger scale, showing a detail of the arrangement of FIG. 1 with a fastening member.

FIG. 2 of the drawing shows a fastening member which includes a fastening element 12 on the side of and connected to the shaft wall, a fastening element 14 on the side of and connected to one of the guide rails 10, wherein a rail clamp 28 of the fastening element 14 is visible in the drawing. The fastening member further includes a left and a right spring stirrup $\mathbf{13}_1$ and $\mathbf{13}_2$, respectively. The spring stirrups are connected with their bent ends 21 on the side of the rail to the fastening element 14 and with the other end 25 to an adjusting element 27.

The shape of the spring stirrups $\mathbf{13}_1$ and $\mathbf{13}_2$ and the type of the their connection at the respective fastening element 14 on the side of the rails and on the fastening element 12 on the side of the wall shall be explained in detail below with the aid of FIGS. 3 and 4. The spring stirrup 13 is bent at a right angle with a certain radius at its upper end on the side of the rails and this upper end has reduced diameter portions forming steps. Connected to this upper end which is bent at a right angle is a straight portion 20 to which, in turn, is connected a bent end 22 on the side of the wall. The end 22 has approximately the shape of a quarter circular arc. The planes in which the bent ends of the spring stirrup 13 are located extend at a right angle relative to each other.

Figure 3:
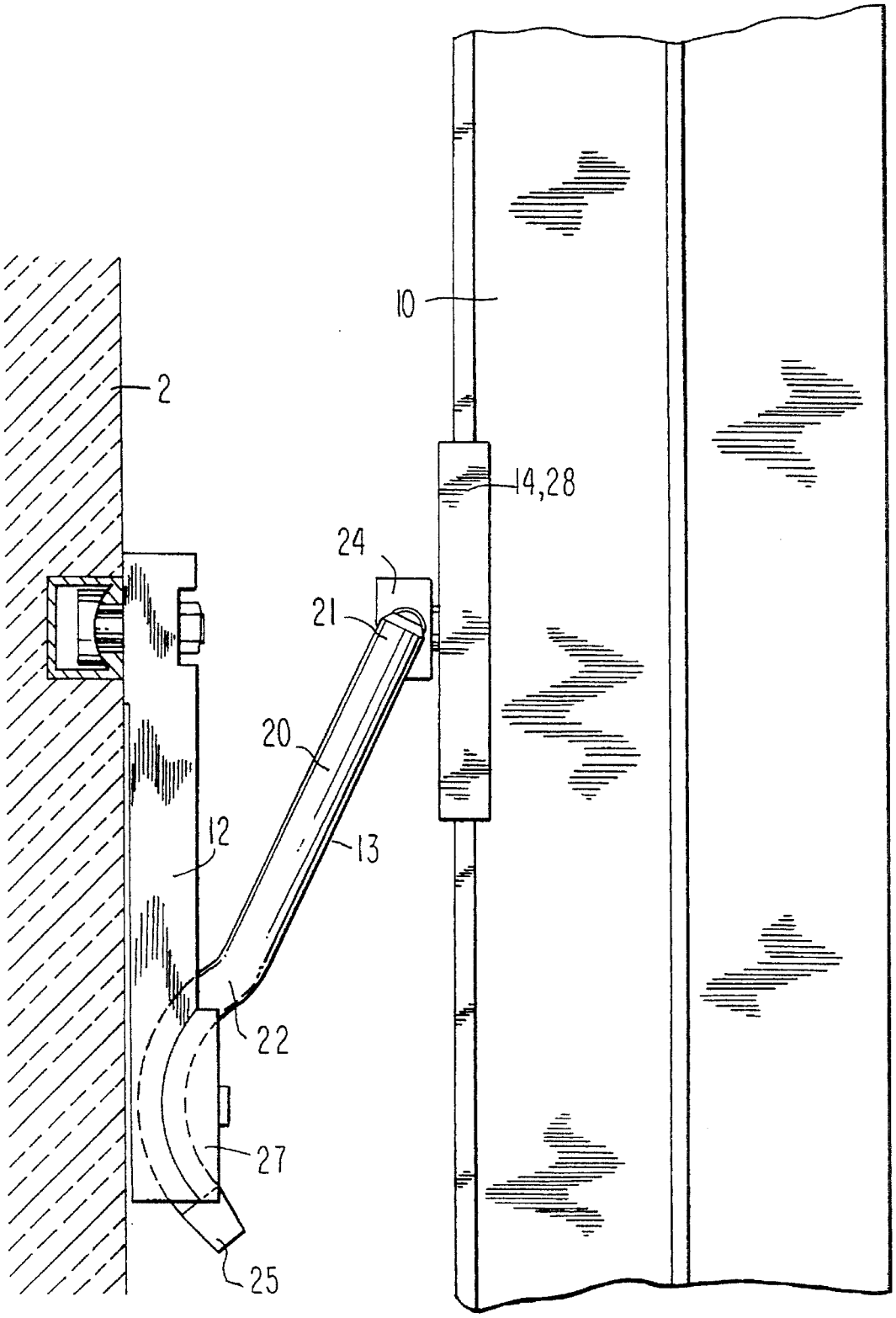
FIG. 3 is a side view showing the fastening elements between shaft wall and guide rail.

As illustrated in FIG. 3, the spring stirrup 13 is fastened with its end 25 which is bent in the shape of a circle to the fastening element 12 on the side of the wall by means of a clamping element 27 which facilitates an adjustment of the spring stirrup 13 with respect to the angle position thereof relative to the wall. FIG. 3 of the drawing shows an approximate maximum distance between guide rail 10 and wall 2. With its bent end 21 on the side of the rail, the spring stirrup 13 is received in a pivoting bearing 4 which is connected to a rail clamp 28 in the manner described below with the aid of FIG. 4.

Figure 4:
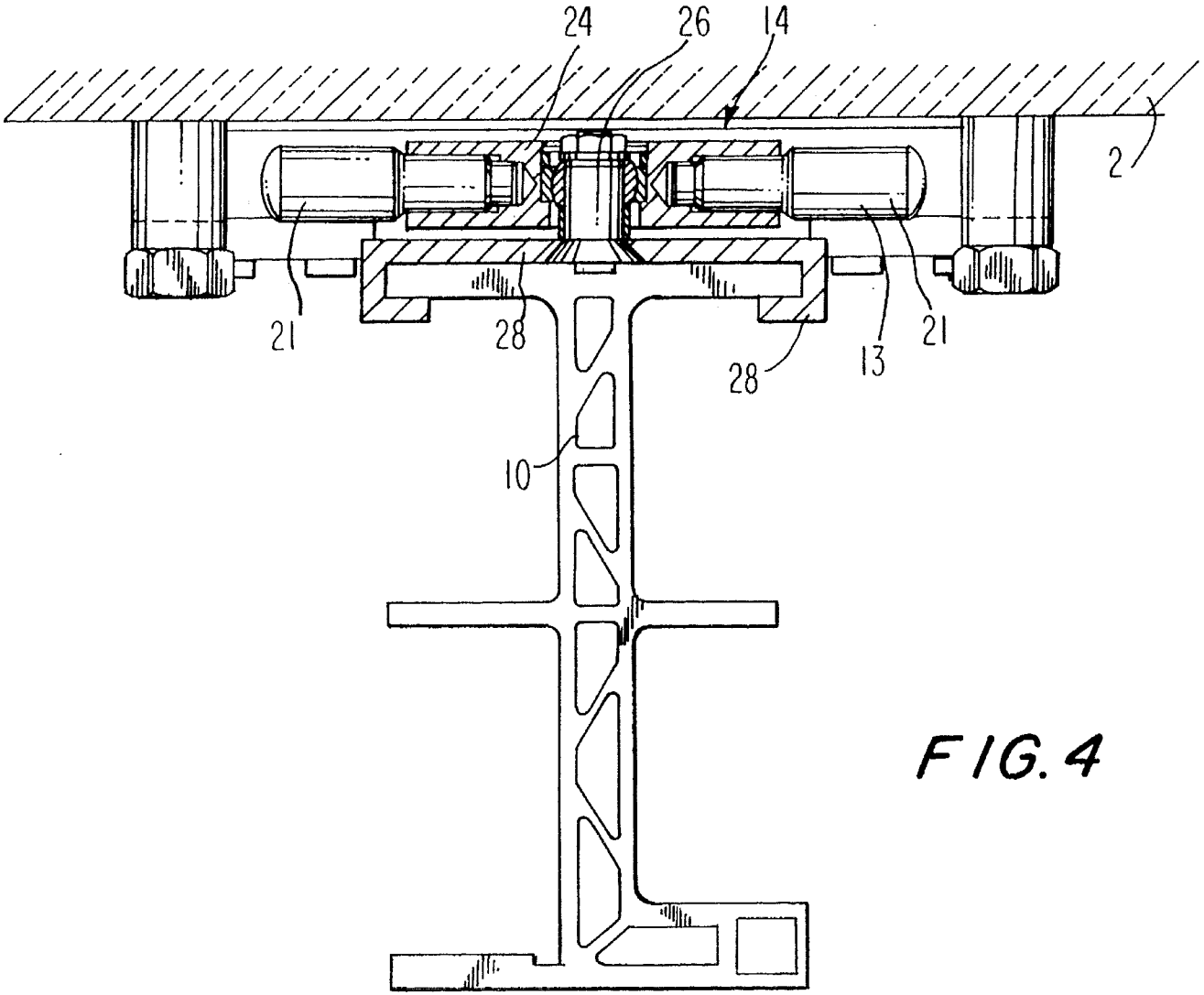
FIG. 4 is a cross-sectional view of a fastening element on the side of and connected to a guide rail.

FIG. 4 of the drawing shows that the ends 21 of the spring stirrup 13 are pivotally hinged in a pivoting joint 24 of the fastening element 14 on the side of the rails. Moreover, another joint member 26 is pivotally hinged to the fastening element 14 for facilitating a pivoting of the guide rail 10 about an axis extending parallel to the axis of the guide rail. The maximum pivoting angle is approximately five degrees.

Figure 5:
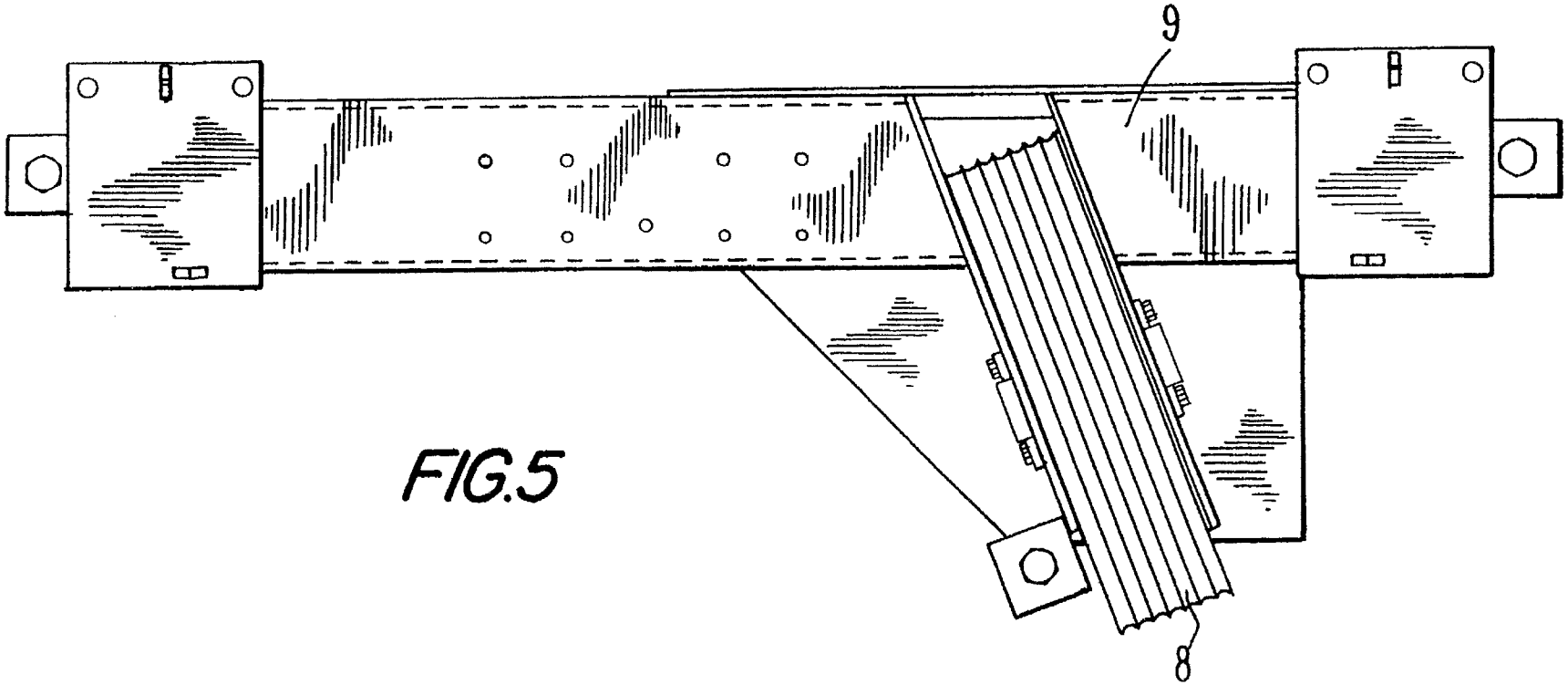
FIG. 5 is a view of a base carrier.

FIG. 5 of the drawing is a top view of the lower base carrier 9 with a cable roller 8 connected to the base carrier 9. The lower base carrier 9 additionally has fastening means for fastening a drive system.

Figure 6:
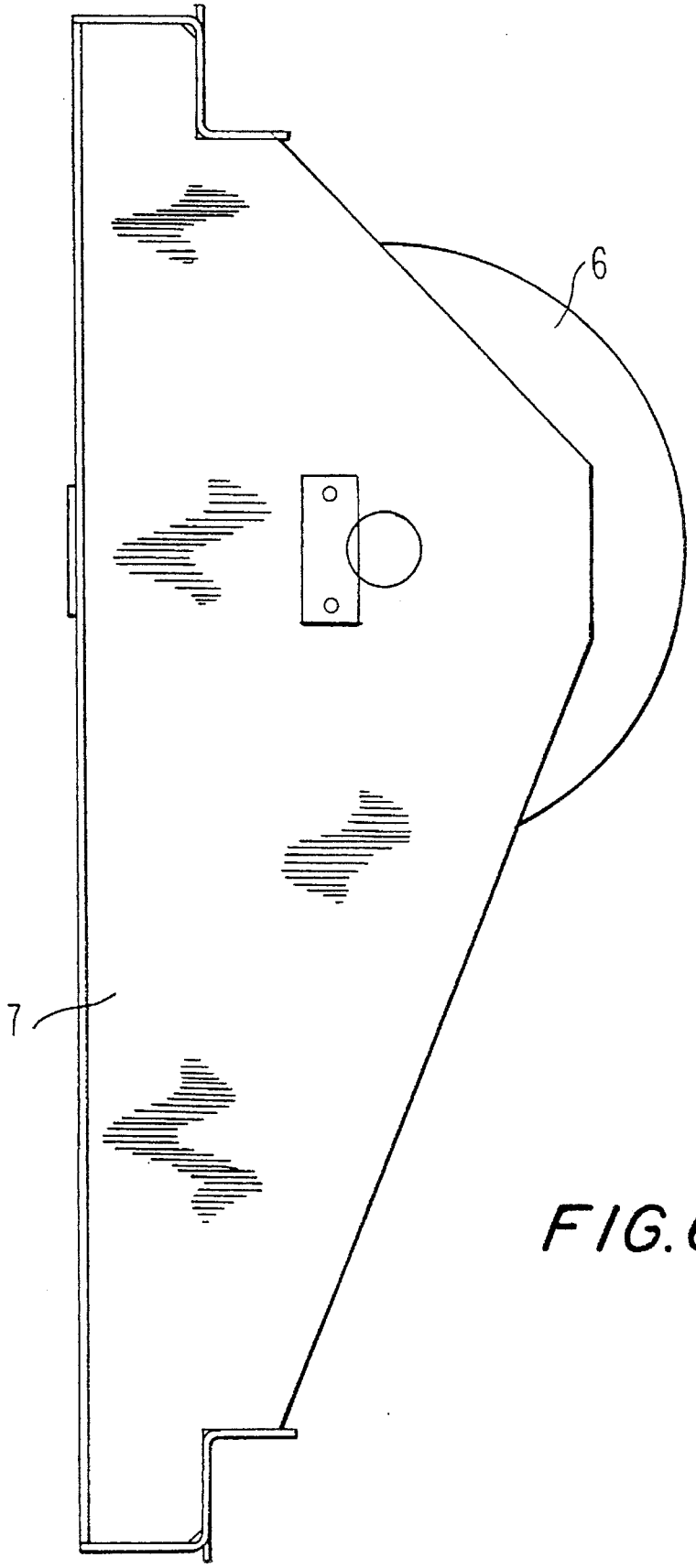
FIG. 6 is a view of an upper suspension carrier.

The upper suspension carrier 7 illustrated in FIG. 6 includes a loose guide roller 6.

Figure 7:
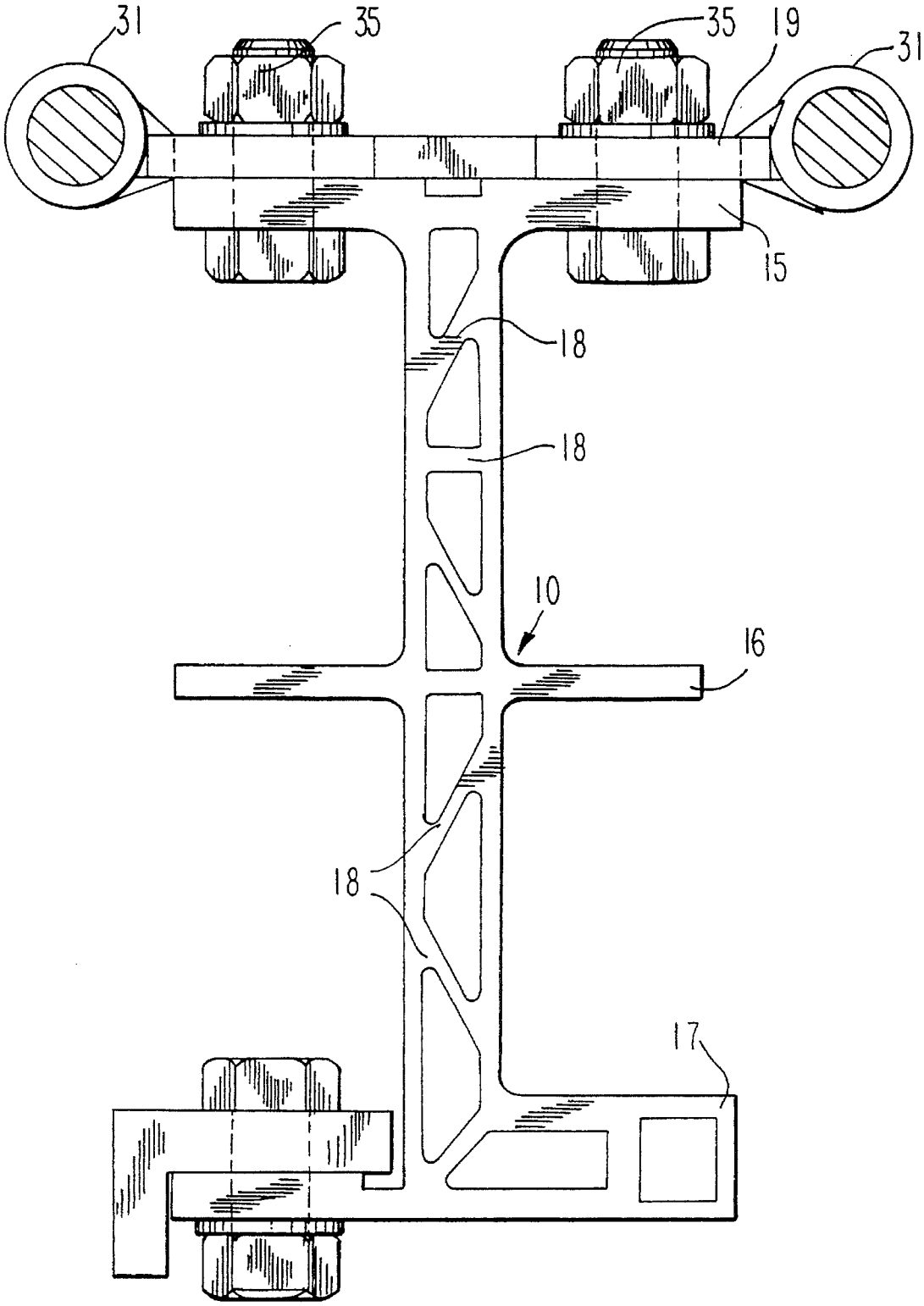
FIG. 7 is a cross-sectional view of a rail joint connector together with the preferred guide rail section.

FIG. 7 of the drawing shows the triple T hollow aluminum section used for the guide rails and a rail joint connector 19. The triple T hollow aluminum section includes inner stiffening ribs 18. The transverse webs 15, 16, 17 of the guide rail 10 which project essentially symmetrically toward both sides are spaced approximately at equal distances from each other. The elevator car is guided between the transverse webs 16 and 17. The joint connector 19 connecting the abutting guide rails 10 at the upper transverse web 15 in FIG. 7 has screw flanges 31 on both sides thereof and is connected to the transverse web 15 by means of several screw connections 35.

Figure 8:
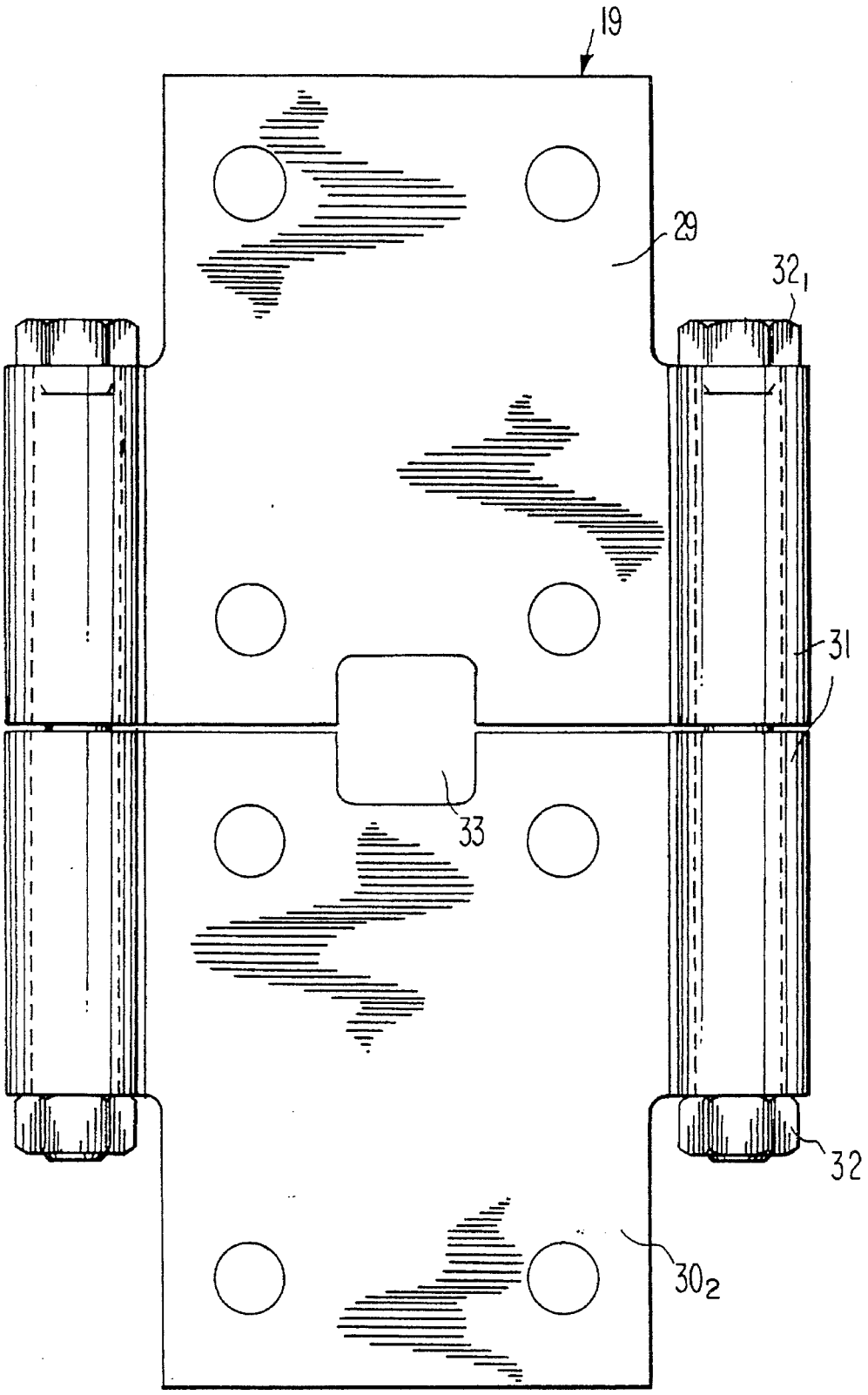
FIG. 8 is a side view of the rail joint connector according to FIG. 7.

The joint connector of FIG. 7 is shown in FIG. 8 in a side view. As shown in FIG. 8, the screw flanges 31 on the left and on the right are screwed together by means of bolt and nut screw connections $\mathbf{32}_1$ and $\mathbf{32}_2$. The screw connections for connecting the joint connector 19 to the guide rail 10 are not illustrated in FIG. 8. Instead, the bores provided for these connections are visible. The joint connector 19 is composed of two connecting members 29 and 30 which are constructed symmetrically with respect to each other. A recess 33 is provided in the center of the joint connector for securing the connector during assembly.

Figure 9:
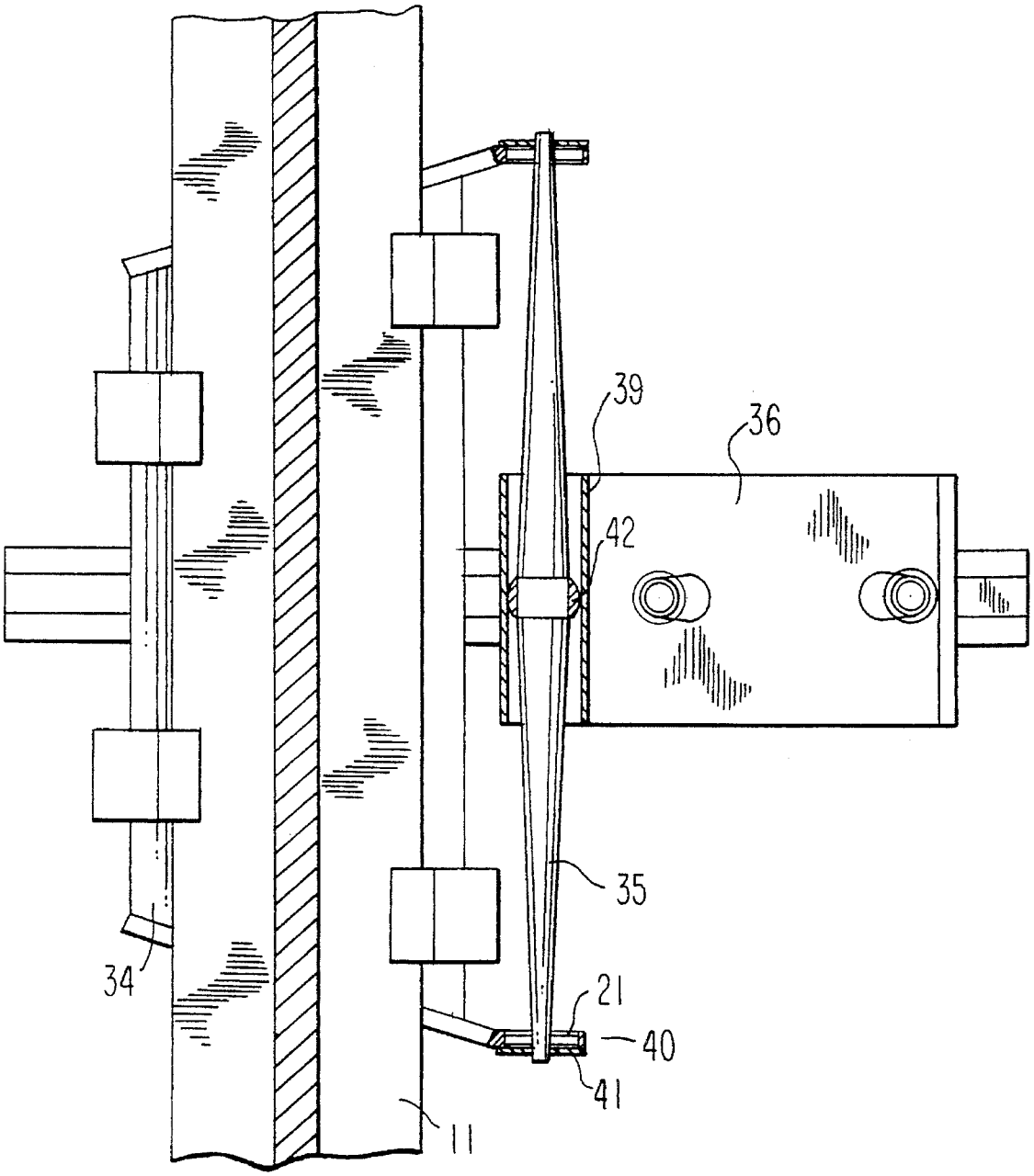
FIG. 9 is a front view, partially broken away and partially in section, of another configuration of the fastening members.
Figure 10:
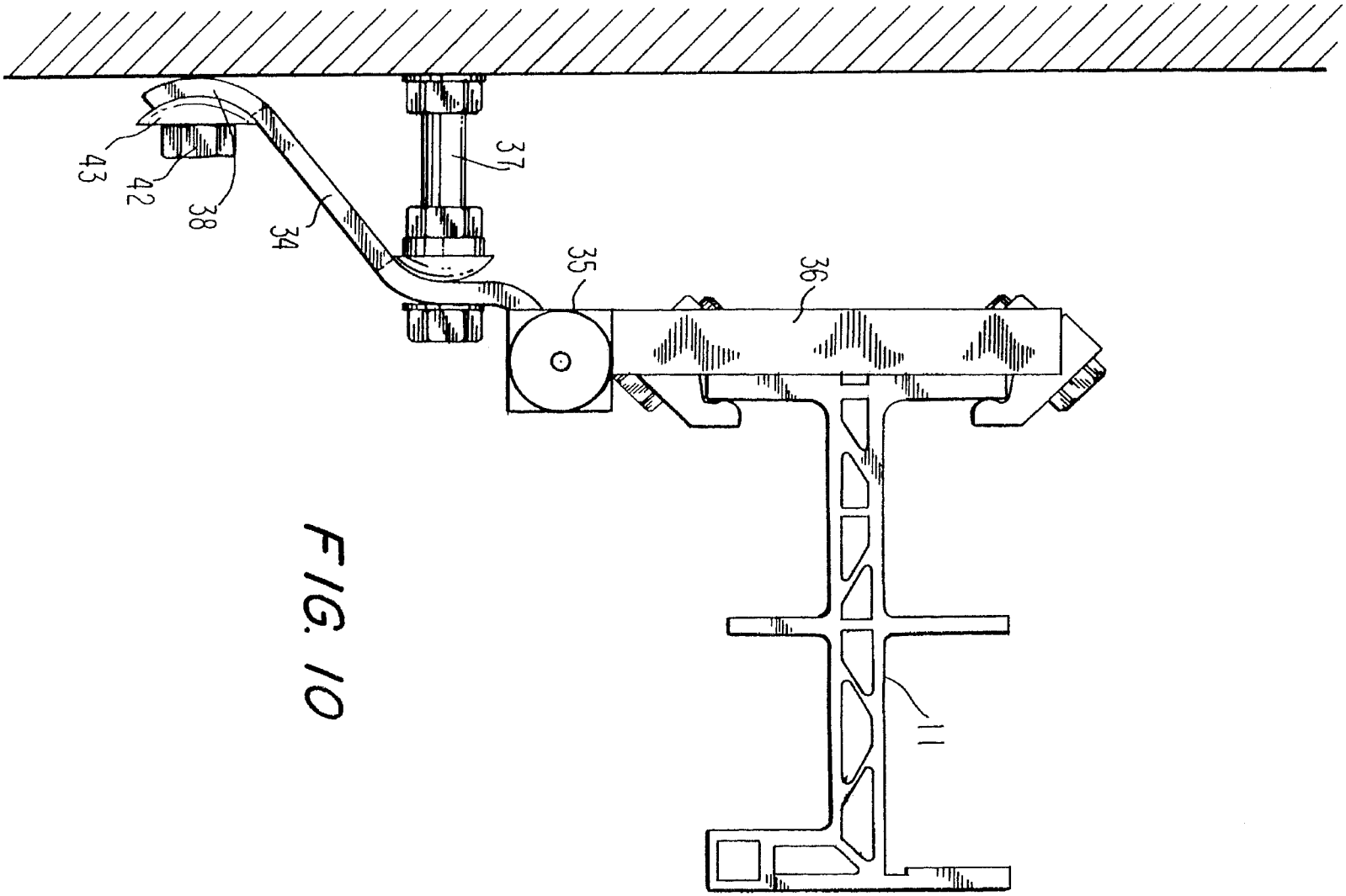
FIG. 10 is a top view of the fastening members of FIG. 9.

As illustrated in FIGS. 9 and 10, the connection between the rails 10, 11 and the shaft wall is effected by means of a fastening member 34–36 which is of different construction. In this case, the fastening element 34 on the side of the wall is connected to the shaft wall by means of a screw 42. A spherical element 43 is provided between the screw 42 and the fastening element 34, so that the angular position of the fastening element 34 relative to the shaft wall and, thus, the distance of its other end from the wall, can be changed. A spacer 37 whose length is adjustable is provided for this purpose.

Two bearings 40 are arranged at the free ends of the fastening element 34 on the side of the wall. Each bearing 40 includes a disk 21 which is mounted in a bearing shell 41 so as to be pivotable to a small extent. The disk 21 serves to receive a spring rod 35 which, in turn, is longitudinally slidably mounted in a sleeve 39 of the fastening element 36 on the side of the rail. A spherical joint member 42 is provided between the spring rod 45 and the sleeve 39, so that an additional pivoting movement is facilitated. Thus, the guide rails 10, 11 are again mounted in a manner which is cardanic within certain limits.

The invention is not limited by the embodiment described above which is presented as an example only but can be modified in various ways within the scope of protection defined by the appended patent claims.

We claim:

1. A guide arrangement for elevators, particularly for vertical elevators, the guide arrangement being arranged in a shaft having a shaft wall, the guide arrangement comprising a self-contained inherently stiff rail frame, the rail frame comprising at least two parallel guide rails which are rigidly connected to each other, further comprising fastening members for connecting the rail frame to the shaft wall, wherein the fastening members comprise springs.

2. The guide arrangement according to claim 1, wherein each fastening member has a fastening element on the side of the shaft wall and a fastening element on the side of the guide rail, and wherein the fastening elements are connected to each other by the springs.

3. The guide arrangement according to claim 2, wherein each fastening member comprises two spring stirrups symmetrically relative to a longitudinal axis of the guide rail on both sides thereof, wherein the fastening element on the side of the shaft wall is connected to the fastening element on the side of the guide rail by the two spring stirrups.

4. The guide arrangement according to claim 3, wherein each spring stirrup is constructed as a spring rod with a first approximately right angle bend at an end on the side of the guide rail, wherein the spring stirrup is pivotally hinged at the end on the side of the guide rail to the fastening element on the side of the guide rail, and wherein another end of the spring rod on the side of the shaft wall is connected to the fastening element on the side of the shaft wall.

5. The guide arrangement according to claim 4, wherein each fastening element on the side of the guide rail comprises a pivoting bearing with an articulated member, a rail clamp being clamped to the guide rail, and wherein the rail clamp is connected to the articulated member, such that the pivoting bearing facilitates a slight pivoting of the guide rail about an axis extending parallel to a longitudinal axis of the guide rail.

6. The guide arrangement according to claim 5, wherein each spring rod has on the end on the side of the shaft wall a second approximately quarter circle bend located in a plane which extends perpendicularly to a plane of the first bend on the side of the guide rail, wherein each fastening element on the side of the shaft wall comprises an adjusting element for adjusting and fixing an angle of each spring rod relative to the longitudinal axis of the guide rail and a distance of each guide rail from the shaft wall.

7. The guide arrangement according to claim 2, wherein each spring comprises a spring rod connecting the fastening elements.

8. The guide arrangement according to claim 7, wherein the fastening element on the side of the guide rail comprises a sleeve, the spring rod being longitudinally displaceably mounted in the sleeve, the spring rod comprising a spherical joint member for pivoting the spring rod in the sleeve.

9. The guide arrangement according to claim 8, wherein the fastening member on the side of the shaft wall comprises two oppositely located bearings, the spring rod being pivotally mounted in the bearings.

10. The guide arrangement according to claim 9, wherein each bearing comprises a housing and a disk pivotally mounted in the housing.

11. The guide arrangement according to claim 7, wherein the fastening member on the side of the shaft wall comprises an approximately S-shaped stirrup having an end on the side of the shaft wall, further comprising a fastening means for securing the end of the stirrup on the side of the shaft wall in selected angular positions relative to the shaft wall.

12. The guide arrangement according to claim 11, wherein the fastening member on the side of the shaft wall comprises a spacer member extending toward the shaft wall, the spacer member having an adjustable length and being mounted at a vertical distance from the end of the stirrup on the side of the shaft wall.

13. The guide arrangement according to claim 1, wherein each guide rail comprises integrated elevator car running surfaces and counterweight running surfaces, an additional catch rail and flanges for mounting rail joint connectors.

14. The guide arrangement according to claim 13, wherein each guide rail is a hollow aluminum section with internal stiffening ribs.

15. The guide arrangement according to claim 1, wherein the guide rails have a top and a bottom, the guide rails being fixedly connected to each other at the lower ends thereof by means of a base carrier and at the upper ends thereof by means of an upper suspension carrier.

16. The guide arrangement according to claim 15, wherein the guide rails are additionally connected by cross beams which are arranged at defined distances from each other.

17. The guide arrangement according to claim 15, wherein the base carrier comprises at least one drive roller and the upper suspension carrier comprises at least one guide roller.

18. The guide arrangement according to claim 15, wherein the base carrier is mounted on a shaft bottom.

19. The guide arrangement according to claim 1, wherein a piggyback-type elevator is connected to the guide arrangement.

* * * * *